United States Patent [19]

Blauwhoff et al.

[11] Patent Number: 4,551,233

[45] Date of Patent: Nov. 5, 1985

[54] CONTINUOUS THERMAL CRACKING PROCESS

[75] Inventors: Petrus M. M. Blauwhoff; Anton E. Cornelissen, both of Amsterdam, Netherlands

[73] Assignee: Shell Oil Company, Houston, Tex.

[21] Appl. No.: 643,897

[22] Filed: Aug. 24, 1984

[30] Foreign Application Priority Data

Sep. 2, 1983 [GB] United Kingdom ..... 8323635

[51] Int. Cl.[4] ..... C10G 9/00

[52] U.S. Cl. ..... 208/106; 208/72; 208/75; 422/134

[58] Field of Search ..... 208/72, 75, 106, 157, 208/131, 168, 169; 422/129, 134

[56] References Cited

U.S. PATENT DOCUMENTS

| | | | |
|---|---|---|---|
| 3,344,057 | 9/1967 | Patrick | 208/131 |
| 4,247,387 | 1/1981 | Akbar | 208/106 |
| 4,443,328 | 4/1984 | Sakurai et al. | 208/106 |
| 4,487,686 | 12/1984 | Gomi et al. | 208/72 |

*Primary Examiner*—D. E. Gantz
*Assistant Examiner*—Anthony McFarlane
*Attorney, Agent, or Firm*—Kimbley L. Muller

[57] ABSTRACT

A process is described for the continuous thermal cracking of hydrocarbon oils, which process comprises heating a hydrocarbon oil feed, introducing the hot feed into a soaking vessel having its interior divided into a plurality of consecutive, interconnected compartments, and causing hot liquid to pass through the consecutive compartments prior to withdrawal of liquid material from the soaking vessel. The gas present in each compartment is collected and is separately withdrawn from the soaking vessel.

1 Claim, 5 Drawing Figures

FIG.1
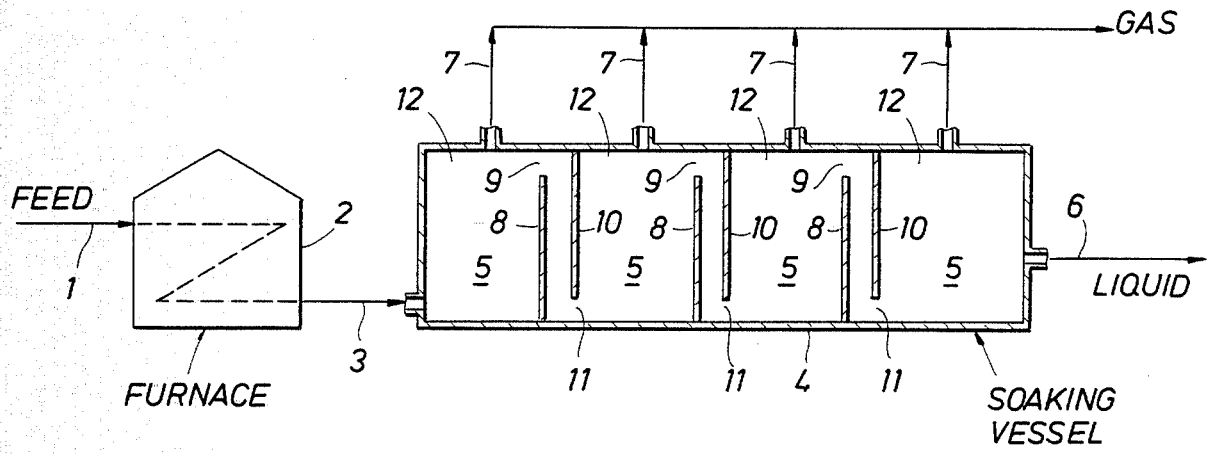
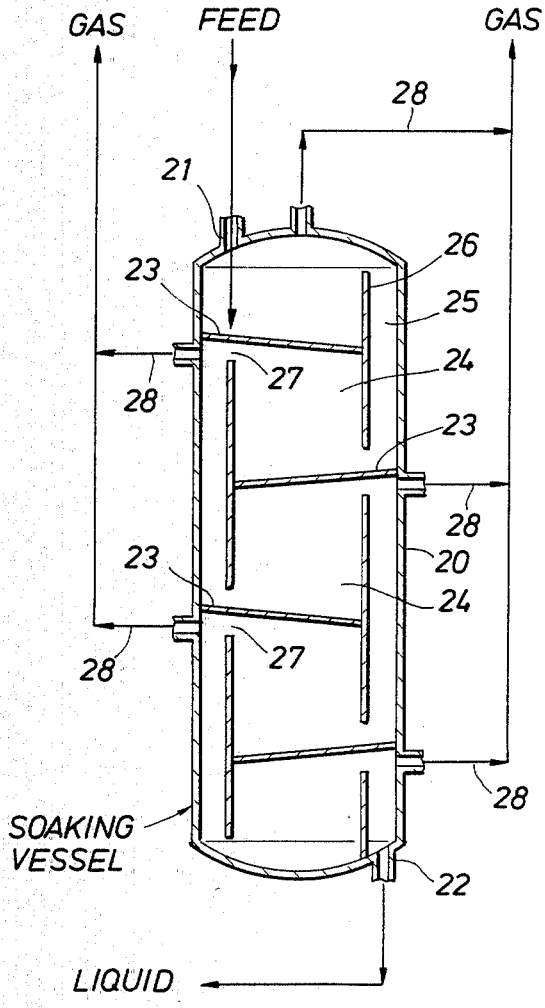
FIG. 2
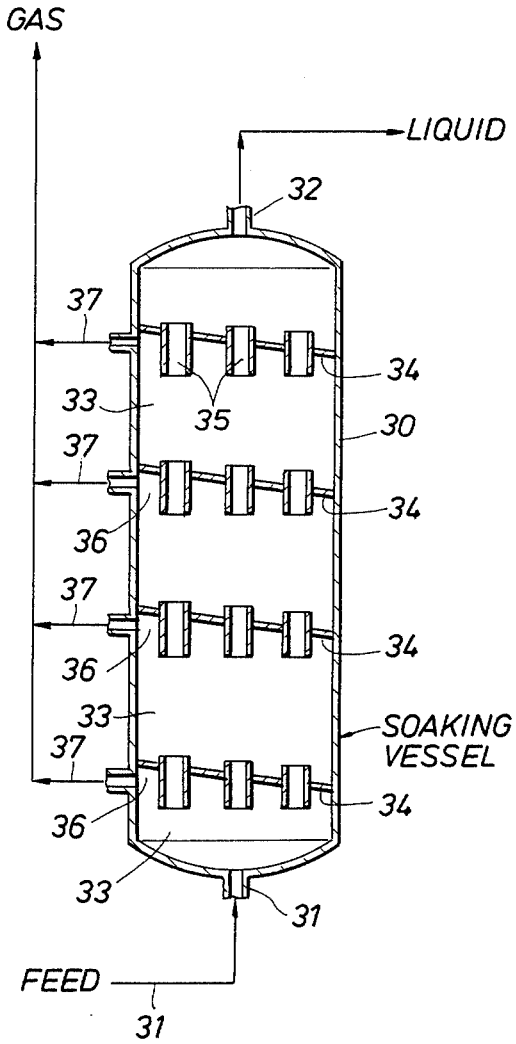
FIG.3

CONTINUOUS THERMAL CRACKING PROCESS

BACKGROUND OF THE INVENTION

The present invention relates to a process for the continuous thermal cracking of hydrocarbon oils.

The atmospheric distillation of crude mineral oils for the preparation of light hydrocarbon oil distillates, such as gasoline, kerosene and gas-oil, yields an asphaltenes-containing residue as a byproduct. Originally such residues used to be utilized as heavy fuel oil for low speed engines and power stations. In view of the growing demand for light hydrocarbon oil distillates and the shrinking demand for heavy fuel oils and asphalt, various treatments aiming at the preparation of light hydrocarbon oil distillates from atmospheric residues have been proposed and are commercially applied.

A well known treatment of residual oils for preparing light products is thermal cracking. For the thermal cracking of residual feedstocks two types of processes are available, namely furnace cracking and soaker cracking. Furnace cracking implies that the actual cracking takes place at the downstream end of a furnace and to some extent in the transfer line between the furnace and a subsequent treating unit. The residence time of the feedstock in the cracking zone is relatively short, of the order of only one minute. In the case of soaker cracking, the feed is heated to a suitable temperature, which is considerably lower than the temperature applied in furnace cracking, and the feed is allowed to stay at that temperature for a period of usually 10–30 minutes in a vessel known as a soaker. A soaker can be defined as an elongated vessel without supplementary heating, which vessel allows cracking to take place over a prolonged period. No heat is provided to the soaker and, since the cracking reaction is endothermic, the temperature of the oil drops by about 10°–30° C. during the passage through the soaker.

Soaker cracking, also known as visbreaking, has staged a come-back as a convenient and relatively inexpensive step toward reducing fuel oil residues. Especially during the last decennia, savings of production costs have become of paramount concern. The process of visbreaking has major advantages over furnace cracking, viz., lower capital costs, lower fuel consumption and longer onstream times.

U.S. Pat. No. 1,899,889 mentions a method for the thermal cracking of petroleum oils, which method comprises heating the oil, introducing the hot feed into a soaking vessel in which most of the cracking takes place and subsequently conducting the cracked liquid and formed vapors into a fractionating zone. According to this publication the hot feed is introduced and vaporous products leave through a common line at an upper portion of the vessel.

The conversion obtained by thermal cracking operations is the result of the two main operating variables, viz. temperature and residence time. The desirable effect of thermal cracking, i.e. the decrease of the viscosity of the feedstock, arises from the fact that larger molecules have a higher cracking rate than smaller molecules. At lower temperatures the difference in cracking rates between larger and smaller molecules increases and hence influences the desirable effect positively. At very low temperatures the cracking rate however decreases to uneconomically small values. In view of these aspects, the temperature in a soaking vessel is preferably chosen in the range between about 400° and 500° C.

The residence time in a soaking vessel depends upon the configuration and size of the vessel as well as the pressure in the vessel. High pressure will cause only a small vapor flow to be produced which results in a relatively low vapor holdup in the vessel and therefore a relatively long residence time of liquid feed. Low pressures have on the contrary a decreasing effect on the residence time of the liquid feed. At a given configuration and size of a soaking vessel, the prevailing pressure should be so chosen as to allow for a sufficient residence time of the liquid feed. The pressure is preferably in the range of from about 2 to 30 bar.

The rate of conversion, or in other words the cracking severity, is in general limited by the storage stability of the cracked product. The stability properties of the product deteriorate as the cracking proceeds. The average rate of conversion can be regulated by controlling the temperature of the feedstock and the residence time of the feed in the used soaking vessel. In soaker cracking operation a further effect, besides temperature and residence time, influences the product stability. This further effect is induced by gas formation during the cracking. Formed gas will induce back-mixing or swirl of the feedstock in the soaking vessel, causing a spread in the liquid residence time at cracking temperature. As a result thereof part of the feed gets overcracked and influences the stability of the total product from the vessel negatively, while another part of the feed gets undercracked, in that it is insufficiently converted into lighter products.

An important reduction of back-mixing in a soaking vessel may be obtained by providing the vessel with internals dividing the interior of the vessel into a plurality of compartments. Heated feed is allowed to crack in a soaking vessel in which internals, preferably formed by perforated plates, have been arranged. The swirling motion occurring in soaking vessels not provided with internals upon gas formation is in fact transformed due to the presence of such internals, into a plurality of relatively small swirls, resulting in a steep decrease of overall back-mixing and therefore an improved product stability. By increasing the number of compartments in a soaking vessel, back-mixing can be further restricted. The height of the compartments or in other words the distance between adjacent internals should however be sufficient in order to allow inspection and maintenance.

Vapors evolved in the compartments of the soaking vessel pass with the liquid feedstock/product through the upstream compartments and are recovered from the vessel together with the liquid product. If the amount of gas generated in the soaking vessel is rather moderate, the provision of compartments in the vessel will normally be sufficient for generating a product having an acceptable stability. If, however, the operating conditions and/or the composition of the feedstock are such that large quantities of gas are generated, or are already present in the feed to the soaking vessel, the compartmented division of the vessel may be insufficient for preparing products with optimal stability.

The object of the present invention is to further improve the above known process using a compartmented vessel, in order to remove gaseous products as quickly as possible so as to reduce or even prevent overcracking and thus optimizing the stability of the product prepared.

SUMMARY OF THE INVENTION

According to the invention, a process is provided for the continuous thermal cracking of hydrocarbon oils, which comprises heating a hydrocarbon oil feed, introducing the hot feed into a soaking vessel, having its interior divided into a plurality of consecutive, interconnected compartments and causing hot liquid to pass through the consecutive compartments prior to withdrawal of liquid material from the soaking vessel, and wherein gas present in each compartment is collected and is withdrawn separately from the vessel.

DETAILED DESCRIPTION OF THE INVENTION

In the above process according to the invention, gas generated during the cracking process or during the heating-up period and present in the feed to the soaker vessel is substantially prevented from passing through the whole length of the vessel, as it is removed from the vessel as soon as possible, i.e., substantially directly after formation. In the known compartmented soaking vessels, gas formed during the cracking is only withdrawn from the vessel together with the liquid product stream at the outlet of the vessel. This means that the gas evolved in a compartment will flow to adjacent upstream compartments and will contribute to the axial mixing in these further compartments. In the process according to the invention the axial mixing in a compartment of a soaking vessel is considerably reduced as it is only induced by the gas formed in the compartment itelf and not or only marginally by gas from other compartments.

The process according to the invention may be carried out in a horizontally extending vessel or in a vertical vessel. When using a vertical vessel, the heated feedstock may be introduced in the lower part of the vessel and subsequently caused to flow in upward direction. It is also possible, and indeed preferred, to supply the feedstock in the upper part of the vessel and to allow the feed to flow in downward direction. Hereinafter these two possibilities will be indicated with the expressions process with upward flowing feedstock and process with downward flowing feedstock. If the cracking process is carried out in a horizontal vessel the feedstock is introduced at one end of the vessel and allowed to flow in substantially horizontal direction towards the product outlet at the opposite end of the vessel.

When the thermal cracking process according to the invention is carried out in a horizontally extending vessel, a horizontal vessel is applied which is internally provided with a plurality of substantially vertically extending separating means dividing the interior of the vessel into a plurality of consecutive compartments, wherein the separating means each consists of a pair of spaced apart separating walls, from which the wall closest to the feed inlet is erected from the lower end of the vessel and provides a fluid passage at or near the upper end of the vessel thereby defining a gas collecting space in each compartment and the wall closest to the product outlet is spaced down from the upper end of the vessel and provides a fluid passage at or near its lower end for the supply of liquid from the upper part of a compartment to the lower part of an adjacent compartment.

Upon operation of the above horizontal vessel described herein, feedstock is supplied into a first compartment, e.g. into the lower part thereof, and subsequently flows through the compartment, e.g. in upward direction and is discharged from said compartment to the lower part of a next compartment via a pair of cooperating separating walls. Formed gas as well as gas already present are collected per compartment at the upper part thereof and separately withdrawn from the vessel.

In a preferred embodiment of the horizontal vessel, the separating walls erected up from the lower end of the vessel have a height decreasing in downstream direction, i.e. from the feedstock inlet to the liquid outlet. By this arrangement of the separating walls with decreasing height, the overall liquid flow in the vessel is maintained by gravity and the gaseous products can be withdrawn from the vessel without the necessity of controlling the liquid level to prevent liquid entrainment in the gas discharge system.

As already mentioned in the above, the cracking process according to the invention may also be carried out in a vertical vessel with upward flowing feedstock. If this routing is chosen a soaking vessel is used, which vessel is, according to the invention, internally provided with a plurality of superposed inclined separating walls dividing the interior of the vessel into a plurality of superposed compartments, the soaking vessel further comprising fluid passages for the upward flow of liquid hydrocarbon oil, wherein the fluid passages have their lower ends arranged below the separating walls thereby defining in the compartments gas collecting spaces from which separated gas is continuously or intermittently withdrawn. The fluid passages may suitably be formed by elongated open ended tubular elements passing through openings in the separating walls.

A process for thermal cracking with downward flow of feedstock may advantageously be accomplished according to an embodiment of the invention by using a vertically extending vessel internally provided with a plurality of superposed separating walls dividing the interior of the vessel into a plurality of superposed compartments, the vessel further comprising fluid passages for discharging liquid from an upper part of a compartment to a lower part of a next lower compartment, the upper ends of the fluid passages defining in the compartments gas collecting spaces from which separated gas is continuously or intermittently withdrawn.

In order to enable an easy and reliable discharge of gaseous products from the compartments, the separating walls are preferablyinclined wherein the fluid passages are positioned below the higher parts of the separating walls. The fluid passages themselves may be formed by elongated open ended tubular elements passing through openings in the separating walls. In a constructionally more attractive arrangement, the fluid passages are formed by weirs connected to free edges of the separating walls.

Upon operation of the latter type of vessel for downward flow of feedstock, the feedstock is introduced at the top part of the vessel and the liquid components will subsequently flow by gravity through the consecutive compartments. The liquid entering into the lower part of a compartment is directed upward and gas formed is separated and collected in the gas collecting space under the upper separating wall of said compartment. Liquid poor in gas subsequently flows via one or more fluid passages into the lower part of a next lower compartment.

The fluid passages may be so dimensioned that the hydrostatic pressure difference is balanced by the hydrodynamic pressure drop in the fluid passages. In this case the gas collected is available at substantially the same pressure in each compartment and can be discharged from the vessel without level control devices, which might be subject to fouling by coke deposits.

It should be noted that the withdrawal of gas(eous products), aready present or formed during the residence of the feedstock in the individual consecutive compartments can be achieved by lining up all the gas exits of the consecutive compartments into one common conduit. This conduit may be situated outside the soaking vessel (both for horizontally and vertically operating soaking vesels) or may be situated within the soaking vessel when operated in a vertical mode.

BRIEF DESCRIPTION OF THE DRAWINGS

The invention will now be further elucidated by way of example only with reference to the accompanying drawings, in which FIG. 1 schematically shows a vertical cross-section along the longitudinal of a horizontal soaking vessel for thermal cracking of hydrocarbon oils according to the invention;

FIG. 2 schematically shows a vertical section of a vertical vessel for thermal cracking of hydrocarbon oils with downward flow of feedstock according to the invention; and FIG. 3 schematically shows a vertical section of a vertical vessel for thermal cracking of hydrocarbon oils with upward flow of feedstock according to the invention.

DETAILED DESCRIPTION OF THE INVENTION

Figure 5:
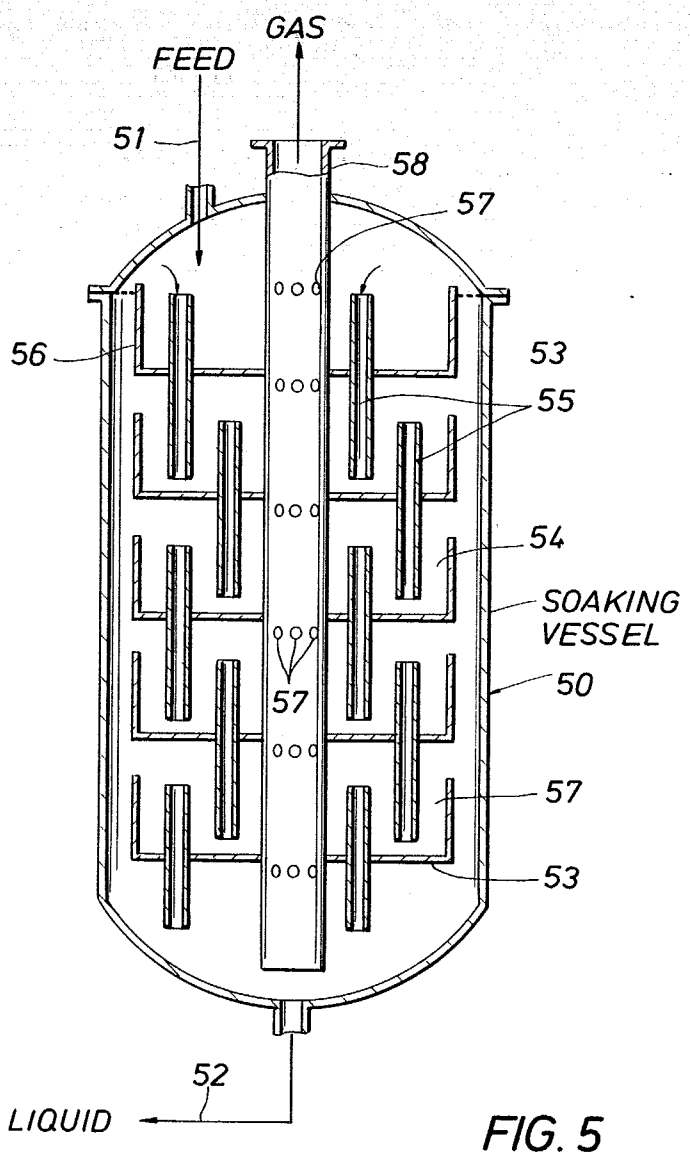
FIG. 5 schematically shows an embodiment similar to the one described in FIG. 4 but being equipped with tubes to allow passage of feedstock/product to the next compartment.

During operation of the equipment shown in FIG. 1, a residual oil feedstock is passed through a line 1 to a furnace 2 where it is heated to a temperature in the range from about 400°-500° C. The hot feedstock is passed through a line 3 into a soaking vessel, 4, in which it is caused to flow in horizontal direction through a plurality of interconnected, juxtaposed compartments 5. The liquid cracked product leaves the vessel via a line 6 through which it is transferred to a separating unit (not shown) to be separated for instance into a gasoline, a heating oil and fuel oil. Gas formed or present in the various compartments of the soaking vessel is collected in the upper part of the appropriate compartments of the vessel and is continuously or intermittently discharged via lines gas withdrawal lines 7. If desired, line 3 may debouch in the middle or the upper part of the first compartment. It is not necessary to carry out the withdrawal via lines 7 at the same time.

The construction of the interior of the vessel is as follows.

The compartments 5 are separated from one another by pairs of separating walls, each pair of walls consisting of a first, upwardly extending wall 8 (closest to the feed inlet) providing a passage 9 at the upper end of the vessel and a closely spaced second, downwardly extending wall 10 (closest to the product outlet) providing a fluid passage 11 at the lower end of the vessel. The height of the upwardly extending walls 8 may decrease from the inlet towards the outlet of the vessel, so that the overall liquid flow in the vessel can be maintained by gravity and the gaseous products evolved during operation of the vessel can be withdrawn without the necessity of controlling the liquid level to prevent liquid entrainment in the gas discharge system. The upwardly extending walls 8 define in each of the compartments 5 gas collecting spaces 12 at the upper part of the vessel. It should be noted that more than four compartments depicted in FIG. 1 may be present in the soaking vessel. It may be advantageous to provide the first compartment with a rather large gas withdrawal system so as to allow withdrawal of gaseous products already present in the feedstock entering via line 3. It should be noted that the fluid passages 9 and 11 may also be formed by openings in the upper part of the walls 8 and in the lower part of the walls 10, respectively.

Reference is now made to FIG. 2, showing a vertical soaking vessel 20 for thermal cracking of hydrocarbon oils flowing in downward direction through the vessel. The vessel is thereto provided with an inlet 21 for feedstock at the top and an outlet 22 for liquid cracking product at the bottom of the vessel. The interior of the vessel is divided by inclined separating walls 23 into a plurality of superposed compartments 24. The fluid communication between adjacent compartments 24 is formed by passages 25 between the wall of the vessel and vertical weirs 26 attached to free ends of the separating walls 23. The upper ends of the vertical weirs 26 are arranged at a distance below the higher parts of the walls 23 thereby forming gas collecting spaces 27 in the upper parts of the compartments. The lower ends of the weirs are positioned near the bottom of the compartments, so that during operation liquid is caused to flow in upward direction through a compartment, thereby preventing the formation of stagnant fluid zones and promoting gas separation. Gaseous products evolved during the cracking process in the vessel are collected in the spaces 27 and withdrawn from the vessel via gas discharge lines 28.

FIG. 3 shows a further embodiment of the vertical soaking vessel illustrating in FIG. 2. A soaking vessel indicated with reference numeral 30 is provided with a feedstock inlet 31 at its bottom and a liquid cracked product outlet 32 at its top. During operation feedstock is caused to flow in upward direction through a plurality of superposed compartments 33 of the vessel.

The compartments 33 are formed by slightly inclined separating walls 34 extending over the whole cross-section of the vessel. These separating walls 34 are provided with open ended tubes 35 extending through openings in said walls. The lower ends of the tubes 35 should be arranged below the lower sides of the separating walls 34, to substantially prevent the major part of the gaseous products from leaving the compartments via said tubes 35. The major part of the gaseous products present in the compartments is collected in the appropriate gas collecting spaces 36 below the lower sides of the separating walls 34 and is continuously or intermittently withdrawn from the vessel via gas discharge lines 37, which need not necessarily to be in operation at the same time although it is preferred to do so. It should be noted that the upper ends of the tubes may extend above or may be flush with the separating walls 34.

Figure 4:
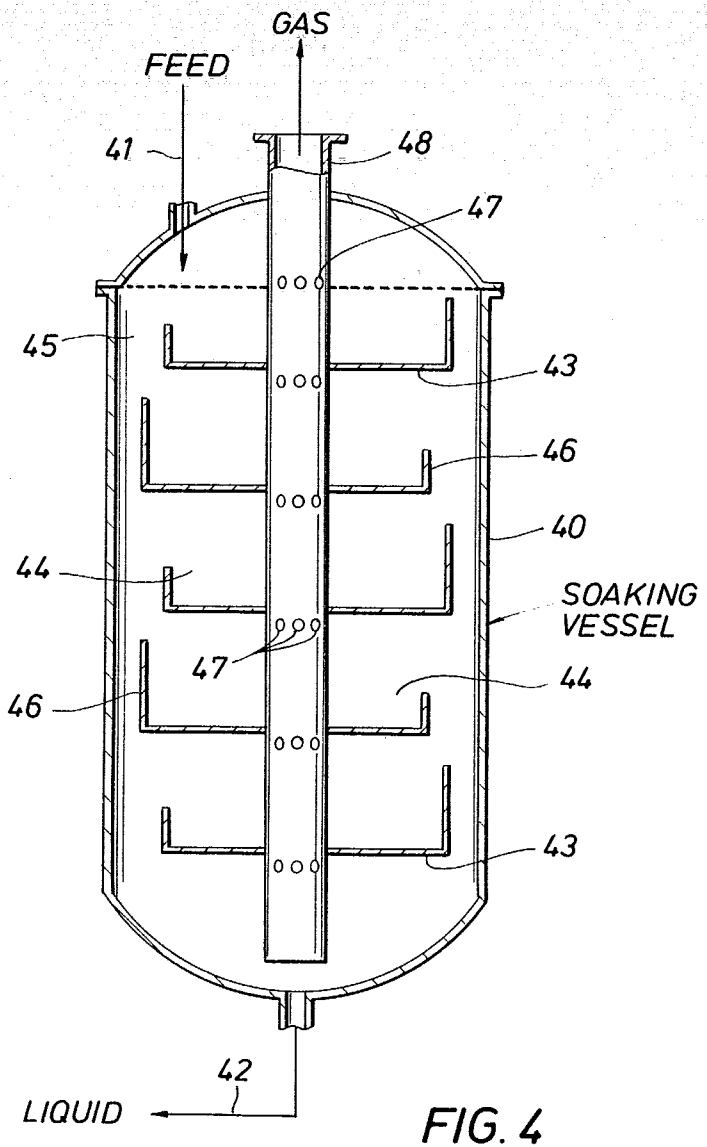
FIG. 4 schematically shows a vertical section of a vertical vessel for thermal cracking of hydrocarbon oils with upward flow having a central discharge line.

FIG. 4 shows a further embodiment of the vertical soaking vessel used in the process according to the present invention.

This vessel 40 is provided with a feedstock inlet 41 at its top and a liquid cracked product outlet 42 at its bottom. The interior of the vessel is divided by separating walls 43 into a number of superposed compartments 44. The fluid communication between adjacent compartments 44 is formed by passages 45 between the wall of the vessel and substantially vertical baffles 46 attached to the free ends of the separating walls 43. The heights of the baffles are preferably different from each compartment and alternating in subsequent compartments so as to introduce a cascade-type movement of feedstock/product through the soaking vessel. The gaseous products present in the various compartments can be withdrawn via openings 47 present in a central discharge system 48, which allows collection of gaseous products at the top of the soaking vessel and which also forms the central axis for the separating walls 43. Preferably, the openings 47 are present in the upper parts of the various compartments, i.e. closest to the feedstock inlets. The openings in the first compartment may be wider or present in a larger number so as to cope with the withdrawal of gaseous products already present in the feed prior to entering the soaking vessel. If desired the top of the soaking vessel may be detachable (dotted line) so as to allow for inspection, cleaning and/or replacement of the separating walls.

FIG. 5 shows a related embodiment of the vertical soaking vessel described in FIG. 4. The vessel 50 is provided with a feedstock inlet 51 at its top and a liquid cracked product outlet 52 at its bottom. The interior of the vessel is divided by separating walls 53 into a number of superposed compartments 54. The fluid communication between adjacent compartments 54 is formed by tubes 55, which openings are lower than the vertically extending baffles 56 of the separating walls 53. The gaseous products present in the various compartments can be withdrawn via openings 57 present in a central discharge system 58 which allows collection of gaseous products at the top of the soaking vessel and which also forms the central axis for the separating walls 53. Preferably, the openings 57 are present in the upper parts of the various compartments, i.e. closest to the feedstock inlets. The openings in the first compartment may be wider or present in a larger number so as to cope with the withdrawal of gaseous products already present in the feed prior to entering the soaking vessel. If desired, the top of the soaking vessel may be detachable.

What is claimed is:

1. A process for the continuous thermal cracking of hydrocarbon oils in a horizontal soaker vessel having an upper end and a lower end, which comprises: heating a hydrocarbon oil feed containing said hydrocarbon oils; introducing said heated hydrocarbon oil feed into said soaker vessel having its interior divided into a plurality of consecutive compartments in fluid intercommunication by means of a plurality of substantially vertical extending separation means, each of said means consisting of a pair (2) of spaced apart separating walls defining a plurality of soaker compartments, wherein said wall of said pair closest to the feed inlet is in physical contact and is erected from the lower end of the soaker vessel and continues upright and terminates at a location proximate to, but not in contact with, the upper end of the soaker vessel to define a fluid passageway above the upper end of said wall and the upper end of said soaker vessel and to define a gas collecting space in the upper end of the soaker vessel in said respective soaker compartment and wherein said wall of said pair closest to the product outlet is in physical contact and is erected from the upper end of the soaker vessel and continues downward and terminates at a location proximate to, but not in connection with, said lower end of the soaker vessel to define a fluid passage below the lower end of said wall, said walls acting to form fluid passage from one compartment to the next adjacent compartment, and wherein the upwardly extending wall decreases in height with respect to the upwardly extending wall in said next adjacent compartment thereby forming a relative larger gas collecting space in the upper end of the soaker vessel in said next adjacent compartment; passing said heated hydrocarbon oils over and under said walls to cause said heated hydrocarbon oils to pass horizontally in a serpentine flow pattern through said soaker vessel; collecting the relative quantity of gas evolved from the heated soaking of said hydrocarbon oils in said respective gas collecting space situated at the upper part of each respective compartment; separately withdrawing said collected gas from each gas collection space contained within said consecutive compartments; and withdrawing thermally cracked hydrocarbon oils from the last of said pluralities of consecutive compartments.

* * * * *